United States Patent [19]

Currie

[11] Patent Number: 4,960,067

[45] Date of Patent: Oct. 2, 1990

[54] ANTENNA SIGNAL DEVICE

[76] Inventor: Aaron D. Currie, Rte. 4, Box 491-H Fulton Ct., Concord, N.C. 28025

[21] Appl. No.: 451,630

[22] Filed: Dec. 18, 1989

[51] Int. Cl.[5] ..... G09F 17/00

[52] U.S. Cl. ..... 116/28 R; 116/173; 343/72

[58] Field of Search ..... 116/28 R, 209, 173–175; 24/17 B, 17 AP, 30.5 P, 306, 442; 40/591, 592; 343/720, 752, 894

[56] References Cited

U.S. PATENT DOCUMENTS

| | | | |
|---|---|---|---|
| 1,294,032 | 2/1919 | Bixby | 116/173 |
| 2,906,234 | 9/1959 | Scott | 116/173 |
| 3,075,492 | 1/1963 | Winfrey | 116/28 R |
| 3,712,263 | 1/1973 | Faragosa | 116/28 R |
| 4,006,818 | 2/1977 | Wannyn | 206/564 |
| 4,038,552 | 7/1977 | Ciofalo | 250/462.1 |
| 4,417,613 | 11/1983 | Ryan et al. | 150/52 R |
| 4,526,820 | 7/1985 | Haas | 428/31 |
| 4,813,369 | 3/1989 | Moreland | 116/173 |

FOREIGN PATENT DOCUMENTS 2847415 5/1980 Fed. Rep. of Germany .... 116/28 R

*Primary Examiner*—William A. Cuchlinski, Jr.
*Assistant Examiner*—W. Morris Worth
*Attorney, Agent, or Firm*—Leon Gilden

[57] ABSTRACT

An apparatus is securable to an uppermost end of an automotive antenna, including an enlarged signal plate diagonally aligned with an elongate body. The body includes a tab member foldable about an upper end of the antenna to define a "U" shaped securement portion. The body further includes spaced parallel slots receiving a flexible line to secure the apparatus to the antenna. Further, the device may include spaced hook and loop fastener strips including a first, second, third, and fourth strip to surroundingly secure the uppermost end of the antenna, and may further include circular slots formed through the signal plate, as well as spaced parallel slots formed through the body member to receive a wire wrap securable to the antenna to enhance securement of the organization to the antenna and to further enhance signal reception provided by the antenna to an associated automotive radio-receiving unit.

4 Claims, 4 Drawing Sheets

ANTENNA SIGNAL DEVICE

BACKGROUND OF THE INVENTION

1. Field of the Invention

The field of invention relates to antenna signalling organizations, and more particularly pertains to a new and improved antenna signal device wherein the same sets forth a surface area to receive various caricatures, slogans and the like reflective of individual personality traits and inclinations.

2. Description of the Prior Art

Various antenna structures have been set forth in the prior art for securement to an associated antenna, but have heretofore been of a relatively complex or awkward organization, as opposed to that of the instant invention which sets forth a readily securable antenna signal member to provide visual observation of individual and personalized ornamentation. Examples of the prior art include U.S. Pat. No. 3,712,263 to Faragosa wherein an automotive aerial locator is securable to an automotive antenna including a brightly colored cylinder resiliently mounted by a surrounding coil spring to a securement bracket securable to the antenna.

U.S. Pat. No. 4,038,552 to Clofalo sets forth a reflective device worn by a person or individual for marking and indication comprising a plurality of spaced polygonal plates with pin portions to secure the plates to an individual.

U.S. Pat. No. 4,006,818 to Wannyn sets forth a package foldable about its center and thereby secures a quantity of material therebetween, wherein the device of the patent is of interest relative to the over-folding manner of securing contents therebetween.

U.S. Pat. No. 4,417,613 to Ryan, et al., sets forth a pacifier which is formed of a split case configuration, wherein the case is hingedly mounted relative to one another to enclose a pacifier therebetween for securement thereof.

U.S. Pat. No. 4,526,820 sets forth a vehicle indicator device for securement to an automotive antenna of a split case configuration including a first and second case half hingedly mounted relative to one another, with interfitting locking pins to secure the case to an associated antenna.

As such, it may be appreciated that there is a continuing need for a new and improved antenna signal device wherein the same addresses both the problems of ease of use as well as effectiveness in construction and in this respect, the present invention substantially fulfills this need.

SUMMARY OF THE INVENTION

In view of the foregoing disadvantages inherent in the known types of automotive signal devices now present in the prior art, the present invention provides an antenna signal device wherein the same is securable about an upper end of an antenna for signal and ornamentation thereof. As such, the general purpose of the present invention, which will be described subsequently in greater detail, is to provide a new and improved antenna signal device which has all the advantages of the prior art automotive antenna signalling devices and none of the disadvantages.

To attain this, the present invention comprises an apparatus securable to an uppermost end of an automotive antenna, including an enlarged signal plate diagonally aligned with an elongate body. The body includes a tab member foldable about an upper end of the antenna to define a "U" shaped securement portion. The body further includes spaced parallel slots receiving a flexible line to secure the apparatus to the antenna. Further, the device may include spaced hook and loop fastener strips including a first, second, third, and fourth strip to surroundingly secure the uppermost end of the antenna, and may further include circular slots formed through the signal plate, as well as spaced parallel slots formed through the body member to receive a wire wrap securable to the antenna to enhance securement of the organization to the antenna and to further enhance signal reception provided by the antenna to an associated automotive radio-receiving unit.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved antenna signal device which has all the advantages of the prior art automotive antenna signal devices and none of the disadvantages.

It is another object of the present invention to provide a new and improved antenna signal device which may be easily and efficiently manufactured and marketed.

It is a further object of the present invention to provide a new and improved antenna signal device which is of a durable and reliable construction.

An even further object of the present invention is to provide a new and improved antenna signal device which is susceptible of a low cost of manufacture with regard to both materials and labor, and which accordingly is then susceptible of low prices of sale to the consuming public, thereby making such antenna signal device economically available to the buying public.

Still yet another object of the present invention is to provide a new and improved antenna signal device which provides in the apparatuses and methods of the prior art some of the advantages thereof, while simultaneously overcoming some of the disadvantages normally associated therewith.

Still another object of the present invention is to provide a new and improved antenna signal device wherein the same is provided with an over-folding tab to surmount the antenna device to an uppermost end of an associated automotive antenna.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
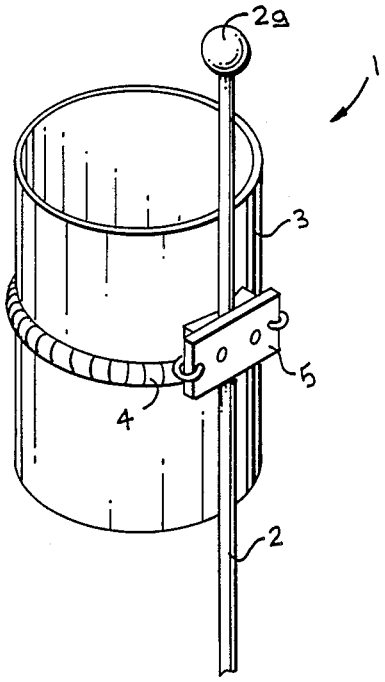
FIG. 1 is an isometric illustration of a prior art antenna signal device.

With reference now to the drawings, and in particular to FIGS. 1 to 8 thereof, a new and improved antenna signal device embodying the principles and concepts of the present invention and generally designated by the reference numerals 10, 10*a*, and 10*b* will be described.

FIG. 1 is illustrative of a typical automotive signal device 1 securable to an automotive antenna 2 that is defined by an upper end 2*a*. The device includes a brightly colored cylinder 3 to provide marking indication of the particular antenna 2, with a coil spring 4 securable about the circumferential perimeter of the cylinder 3, wherein opposed ends of the springs 4 are secured to a bracket 5 to encompass the body of the antenna 2 and secure the device thereto.

Figure 3:
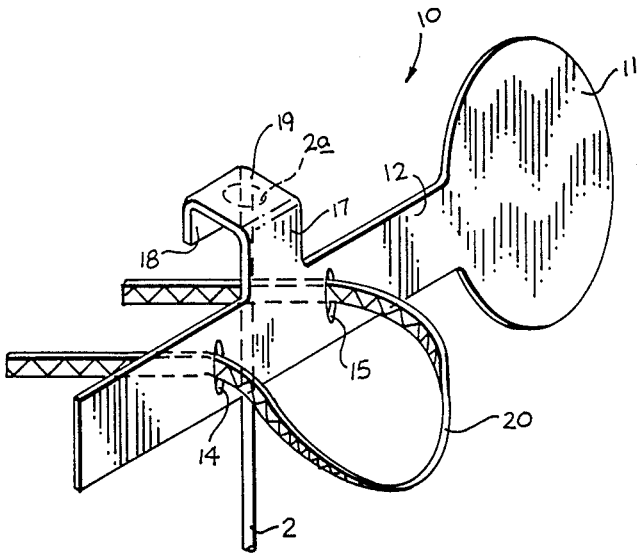
FIG. 3 is an isometric illustration of the instant invention securable about an associated automotive antenna.

More specifically, the antenna signal device 10 of the instant invention essentially comprises an enlarged signal plate 11 illustrated as of a circular configuration in diametrically oriented alignment with an elongate body 12 of a generally rectangular configuration, wherein the signal plate and elongate body are in a single plane. A folding tab 13 defines a "U" shaped configuration, wherein the tab is of a height extending above a top edge 12*a* of the elogate body 12 a distance less than that of the width of the body 12. It should be noted that the signal plate 11 is of a diameter or width substantially greater than that of the height of the body 12 defined between the top edge 12*a* and the bottom edge 12*b*. A plurality of slots defines the first slot 14 and a second slot 15 and are directed and formed through the elongate body 12, wherein the slots are parallel relative to one another and are spaced to each side equal distant thereof of the folding tab 13. FIG. 3 is illustrative of the instant invention 10 secured to an associated automotive antenna 2, wherein the uppermost portion of the automotive antenna 2*a* is positioned medially of a top leg 19 of the "U" shaped folding tab 13. A first leg 17 is spaced parallel to a second leg 18 on opposite sides of the top leg 19, with the first leg 17 integrally and coextensively formed to the elongate body 12 and directed orthogonally and medially upwardly thereof. A flexible securement line 20 is subsequently directed through the first and second slots 14 and 15 and tied and secured about the antenna 2 to maintain the signal device 10 to the antenna 2.

Figure 2:
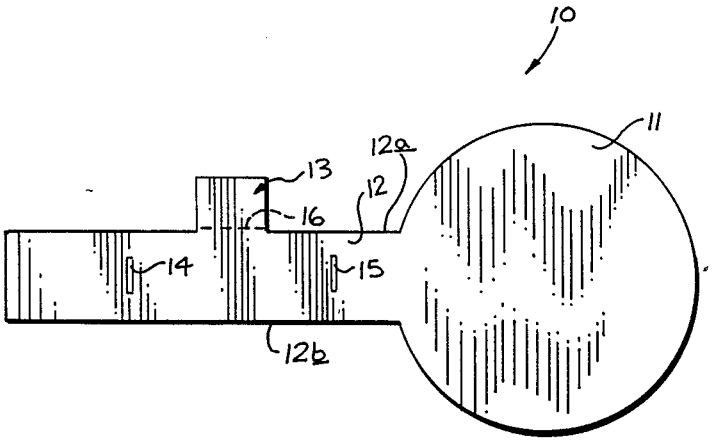
FIG. 2 is an orthographic side view taken in elevation of the instant invention.
Figure 4:
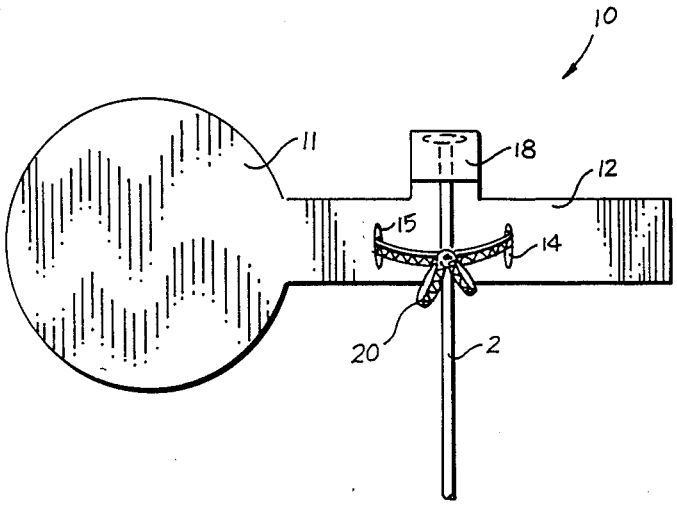
FIG. 4 is a rear orthographic view taken in elevation of the instant invention secured to an automotive antenna.
Figure 5:
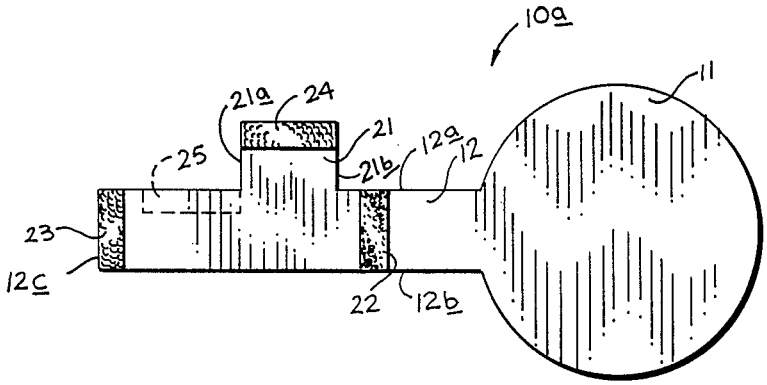
FIG. 5 is an orthographic side view taken in elevation of a modified antenna signal device of the instant invention.
Figure 6:
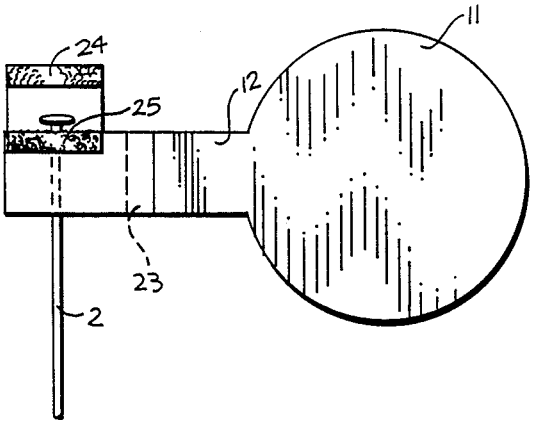
FIG. 6 is an orthographic frontal view taken in elevation of the antenna device of FIG. 5 securable to an associated automotive antenna in an intermediate step of securement thereto.
Figure 7:
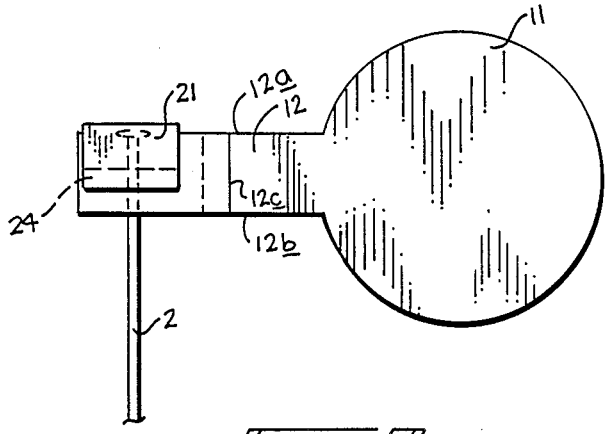
FIG. 7 is an orthographic frontal view taken in elevation of the device of FIG. 5 enclosedly securing an upper end of an automotive antenna.

FIGS. 5, 6, and 7 illustrate a second embodiment 10*a* of the antenna signal device, wherein the elongate body 12 defined by the top edge 12*a*, a parallel bottom edge 12*b*, and orthogonally formed end edge 12*c* in an aligned and integral association with the signal plate 11 of an orientation as defined in FIGS. 2, 3, and 4. A planar flexible tab 21 is mounted medially and orthogonally relative to the top edge 12*a* and is formed with a third hook and loop fastener strip 24 coextensively formed to an upper edge of the tab coextensive between the left and right sides 21*a* and 21*b* respectively. A first hook and loop fastener strip 22 is spaced forwardly of the tab right side 21*b* between the tab 21 and the signal plate 11 and formed orthogonally relative the top and bottom edges 12*a* and 12*b*. The spacing from the first hook and loop fastener strip 22 to the tab left side 21*a* is substantially equal to that spacing defined between the tab left side 21*a* and the end edge 12*c*, wherein a second hook and loop fastener strip 23 folded substantially along a line coextensive with the tab left side 21*a* about the elongate body 12 will position the second hook and loop fastener strip 23 in confrontation with a first hook and loop fastener strip 22. A fourth hook and loop fastener strip 25 formed along the top edge 12*a* between the tab left side 21*a* and the second hook and loop fastener strip 23 is of a length substantially equal to that of the third hook and loop fastener strip 24 and originates substantially in alignment with the tab left side 21*a* whereupon over-folding of the elongate body 12 aligns the fourth hook and loop fastener 25 with the third hook and loop fastener strip 24, as illustrated in FIG. 6, to envelope the upper end 2*a* of the antenna 2 therewithin.

Figure 8:
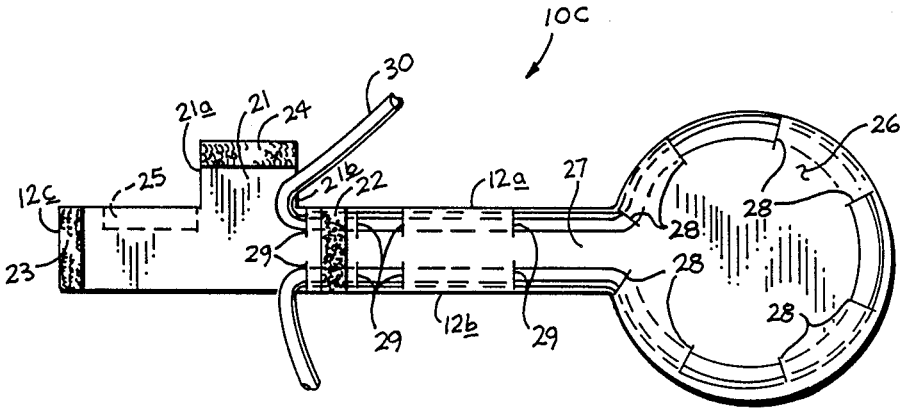
FIG. 8 is an orthographic frontal view taken in elevation of a further modified antenna signal device of the instant invention.

FIG. 8 is illustrative of a third embodiment 10*b* incorporating the features of the second embodiment, as illustrated in FIGS. 5–7, including a modified signal plate 26 that includes a circular array of slots 28 positioned coaxially adjacent the perimeter of the signal plate 26 with spaced parallel rows of body slots 29 formed adjacent upper and lower respective top and bottom edges 12*a* and 12*b* of the elongate body 27, wherein the slots 28 and 29 are aligned to receive a single continuous wire wrap 30 that provides improved features of enhancing securement of the organization 10b to an associated antenna, as well as improving antenna reception itself in the perimeter positioning of the wire 30. The metallic wire 30 is of a configuration to define plural ends, as illustrated in FIG. 8, that are each securable to an associated antenna. The slots 29 formed within the modified body 27 terminate adjacent the tab right side 21b to enable securement and fastening of the remaining hook and loop fastener strips, in a manner as illustrated in FIG. 7.

As to the manner of usage and operation of the instant invention, the same should be apparent from the above disclosure, and accordingly no further discussion relative to the manner of usage and operation of.the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An antenna signal device for securement to an automotive antenna, wherein the antenna includes an upper end, and wherein the device comprises, a signal plate integrally formed to an elongate body member, wherein the signal plate is in planar alignment relative to the body member, and the body member including a top edge, a bottom edge, and an end edge, and a tab means integrally mounted medially of the top edge and extending orthogonally thereto for overlying securement to the upper end of the antenna, and securement means cooperative with the body member to secure the body member to the antenna, wherein the tab means is formed as a "U" shaped member, with a first leg integrally mounted to the top edge of the body member spaced from and parallel to a second leg, wherein the first leg and second leg are joined by a third leg, wherein the third leg is formed orthogonally relative to the first leg and second leg, and the securement means includes a securement line, and the securement means further includes a first slot and a second slot, the first slot and second slot are aligned parallel to one another and spaced on each side of the first leg in orthogonal alignment relative to the top edge of the body member, with the securement line extending through the first slot and second slot for securement about the antenna.

2. An antenna signal device for securement to an automotive antenna, wherein the antenna includes an upper end, and wherein the device comprises, a signal plate integrally formed to an elongate body member, wherein the signal plate is in planar alignment relative to the body member, and the body member including a top edge, a bottom edge, and an end edge, and a tab means integrally mounted medially of the top edge and extending orthogonally thereto for overlying securement to the upper end of the antenna, and securement means cooperative with the body member to secure the body member to the antenna, wherein the tab means includes a flexible tab, and the securement means includes a first hook and loop strip coextensive with a spacing defined between the top edge and bottom edge and orthogonally aligned thereto, wherein the first hook and loop fastener strip is positioned between the flexible tab and the signal plate, and further including a second hook and loop fastener strip coextensive with the end edge, and a third hook and loop fastener strip coextensive with a terminal end portion of the flexible tab, and a fourth hook and loop fastener strip mounted to the top edge between the flexible tab an the end edge, and the first hook and loop fastener strip, the second hook and loop fastener strip, and the third hook and loop fastener strip are formed on a first side of the body member, and the fourth hook and loop fastener strip is formed on a further side of the body member.

3. A device as set forth in claim 2 wherein the flexible tab includes a first side and a second side and is defined by a predetermined width, wherein the first side is positioned adjacent the end edge and the second side is positioned adjacent the first hook and loop fastener strip, and the first hook and loop fastener strip is spaced from the first side of the flexible tab a predetermined distance, and the second hook and loop fastener strip is spaced from the first side the predetermined distance, and the fourth hook and loop fastener strip is defined by a predetermined length equal to a predetermined length defined by the third hook and loop fastener strip.

4. A device as set forth in claim 3 including a circular array of slots formed through the signal plate coaxially of the signal plate, and further including an upper and lower row of body slots formed orthogonally relative to the respective top and bottom edge of the body member, and the upper and lower rows of slots terminate a spaced distance from the second side of the flexible tab, and further including an elongate flexible wire member defined by a predetermined length and including free ends extending from the slots, wherein the wire is woven through the upper row of slots, through the circular array of slots, and extending through the bottom row of slots, wherein the wire is securable about the antenna to enhance securement of the device to the antenna and further enhance radio signal reception of the antenna

* * * * *